US008573357B1

(12) United States Patent
Hibbs

(10) Patent No.: US 8,573,357 B1
(45) Date of Patent: Nov. 5, 2013

(54) ACOUSTICAL DOOR

(71) Applicant: Eggers Industries, Inc., Two Rivers, WI (US)

(72) Inventor: Daniel L. Hibbs, Conrath, WI (US)

(73) Assignee: Eggers Industries, Inc., Two Rivers, WI (US)

( * ) Notice: Subject to any disclaimer, the term of this patent is extended or adjusted under 35 U.S.C. 154(b) by 0 days.

(21) Appl. No.: 13/788,146

(22) Filed: Mar. 7, 2013

Related U.S. Application Data

(60) Provisional application No. 61/734,701, filed on Dec. 7, 2012.

(51) Int. Cl.
*E06B 5/20* (2006.01)

(52) U.S. Cl.
USPC ..... 181/287; 181/290; 52/456; 52/784.1; 52/784.15; 52/787.11

(58) Field of Classification Search
USPC ..... 52/456, 784.1, 784.15, 787.11; 181/284, 286, 287, 290, 294, 295
See application file for complete search history.

(56) References Cited

U.S. PATENT DOCUMENTS

| | | | | | |
|---|---|---|---|---|---|
| 1,931,125 | A | * | 10/1933 | Balduf | 52/483.1 |
| 2,880,471 | A | * | 4/1959 | Von Munchhausen | 52/404.1 |
| 3,168,763 | A | * | 2/1965 | Gilbert | 428/45 |
| 3,273,297 | A | * | 9/1966 | Wehe, Jr. | 52/404.1 |
| 3,462,899 | A | * | 8/1969 | Sherman | 52/309.6 |
| 3,573,145 | A | * | 3/1971 | Witkosky et al. | 428/76 |
| 4,317,503 | A | | 3/1982 | Soderquist et al. | |
| 4,610,119 | A | * | 9/1986 | Bench, Sr. | 52/309.3 |
| 4,621,709 | A | * | 11/1986 | Naslund | 181/284 |
| 4,702,046 | A | * | 10/1987 | Haugen et al. | 52/144 |
| 4,838,524 | A | | 6/1989 | McKeown et al. | |
| 4,998,598 | A | * | 3/1991 | Mardian et al. | 181/284 |

(Continued)

FOREIGN PATENT DOCUMENTS

| | | | | | |
|---|---|---|---|---|---|
| CH | 660389 | A | * | 4/1987 | E04B 1/86 |
| CH | 660389 | A5 | * | 4/1987 | E04B 1/86 |

(Continued)

OTHER PUBLICATIONS

3M Industrial Adhesives and Tapes Division, technical data brochure, Double Coated Urethane Foam Tapes (Apr. 2009) 5 pages, St. Paul, USA.

*Primary Examiner* — Robert Canfield
(74) *Attorney, Agent, or Firm* — Michael Best & Friedrich LLP

(57) ABSTRACT

An acoustical door comprising an inner core assembly includes a spacer frame having a first set of spacer strips extending along a first direction and a second set of spacer strips extending along a second direction. The inner core assembly further includes first and second core layers positioned within the spacer frame. The second core layer is constructed of a material dissimilar from the first core layer. The acoustical door further comprises a multi-layer skin spaced apart from the inner core assembly. The multi-layer skin includes a sheet constructed of lead. The acoustical door also includes a spacer coupling the multi-layer skin and the inner core assembly around a mutual periphery. An air space is defined within the mutual periphery and between the multi-layer skin and the inner core assembly such that the multi-layer skin is configured to flex independent of the inner core assembly.

30 Claims, 7 Drawing Sheets

(56) References Cited

U.S. PATENT DOCUMENTS

| | | | | |
|---|---|---|---|---|
| 5,416,285 | A | 5/1995 | Niehaus | |
| 5,424,497 | A | 6/1995 | Dias et al. | |
| 5,547,743 | A | 8/1996 | Rumiesz, Jr. et al. | |
| 5,723,831 | A * | 3/1998 | Martin et al. | 181/287 |
| 5,914,175 | A | 6/1999 | Nudo et al. | |
| 6,112,496 | A * | 9/2000 | Hugus et al. | 52/784.11 |
| 6,196,352 | B1 * | 3/2001 | Goodchild | 181/290 |
| 6,789,645 | B1 | 9/2004 | Deblander | |
| 7,745,005 | B2 | 6/2010 | Tinianov | |
| 7,799,410 | B2 | 9/2010 | Tinianov | |
| 8,074,766 | B1 | 12/2011 | Shore et al. | |
| 8,181,417 | B2 * | 5/2012 | Surace et al. | 52/642 |
| 8,495,851 | B2 * | 7/2013 | Surace et al. | 52/642 |
| 2005/0016121 | A1 | 1/2005 | Hardwick et al. | |
| 2008/0264721 | A1 * | 10/2008 | Tinianov et al. | 181/290 |
| 2009/0194365 | A1 * | 8/2009 | Johnson | 181/290 |
| 2010/0089692 | A1 * | 4/2010 | Dance | 181/290 |
| 2011/0000167 | A1 * | 1/2011 | Dimke | 52/784.1 |
| 2011/0131921 | A1 * | 6/2011 | Chen | 52/784.1 |
| 2012/0214018 | A1 | 8/2012 | Mizrahi et al. | |
| 2013/0167474 | A1 * | 7/2013 | Carlson | 52/784.15 |

FOREIGN PATENT DOCUMENTS

| | | | | |
|---|---|---|---|---|
| DE | 3402967 | A1 * | 8/1985 | E04B 1/99 |
| DE | 3710057 | | 12/1988 | |
| JP | 04314098 | A * | 11/1992 | G10K 11/16 |
| JP | 6186984 | | 7/1994 | |
| WO | 9962295 | | 12/1999 | |

* cited by examiner

ACOUSTICAL DOOR

CROSS-REFERENCE TO RELATED APPLICATIONS

This application claims priority to U.S. Provisional Patent Application Ser. No. 61/734,701 filed on Dec. 7, 2012, the entire content of which is incorporated herein by reference.

BACKGROUND

The present invention relates to door constructions, and particularly to acoustical doors designed for low sound transmission.

SUMMARY

In one embodiment, the invention provides an acoustical door having an inner core assembly. The inner core assembly includes a spacer frame having a first set of spacer strips extending along a first direction and a second set of spacer strips extending along a second direction. In addition, the inner core assembly includes a first core layer positioned within the spacer frame and a second core layer positioned within the spacer frame. The second core layer is constructed of a material dissimilar from the first core layer. The acoustical door further includes a multi-layer skin spaced apart from the inner core assembly. The multi-layer skin includes a sheet constructed of lead. The acoustical door also includes a spacer coupling the multi-layer skin and the inner core assembly around a mutual periphery. An air space is defined within the mutual periphery and between the multi-layer skin and the inner core assembly such that the multi-layer skin is configured to flex independent of the inner core assembly.

In another embodiment, the invention provides an acoustical door having an inner core assembly. The inner core assembly includes a spacer frame having a first set of spacer strips extending along a first direction and a second set of spacer strips extending along a second direction. The first set of spacer strips are bonded to the second set of spacer strips at locations of overlap. In addition, the inner core assembly includes a first core layer positioned within the first set of spacers and a second core layer provided by a plurality of separate panels positioned within the second set of spacers. The second core layer is constructed of a material dissimilar from the first core layer. The acoustical door further includes a skin coupled to the inner core assembly.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figures 1, 1A:
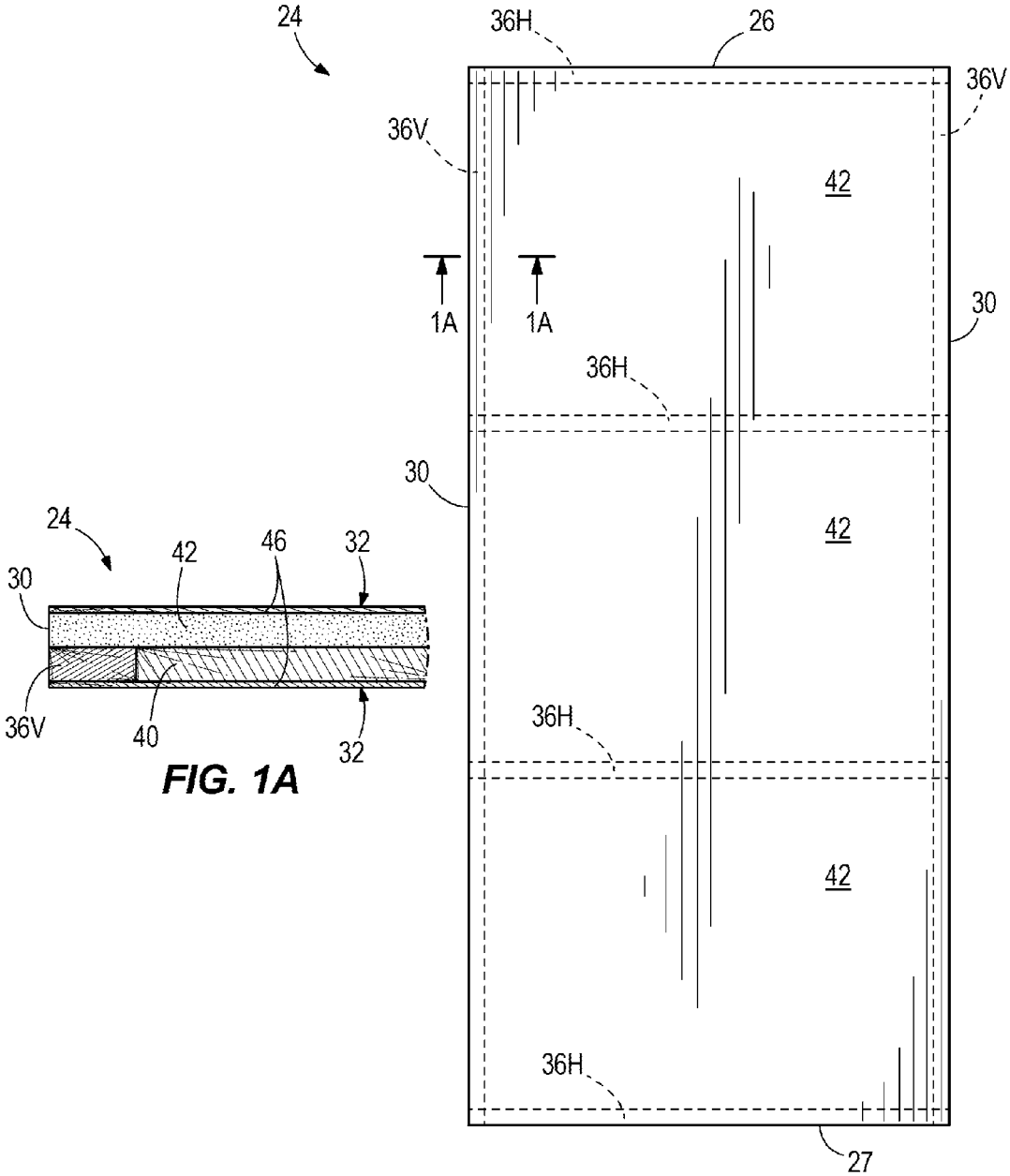
FIG. 1 is a plan view of a core construction for an acoustical door.
FIG. 1A is a cross-section view of the core construction of FIG. 1.
Figure 4:
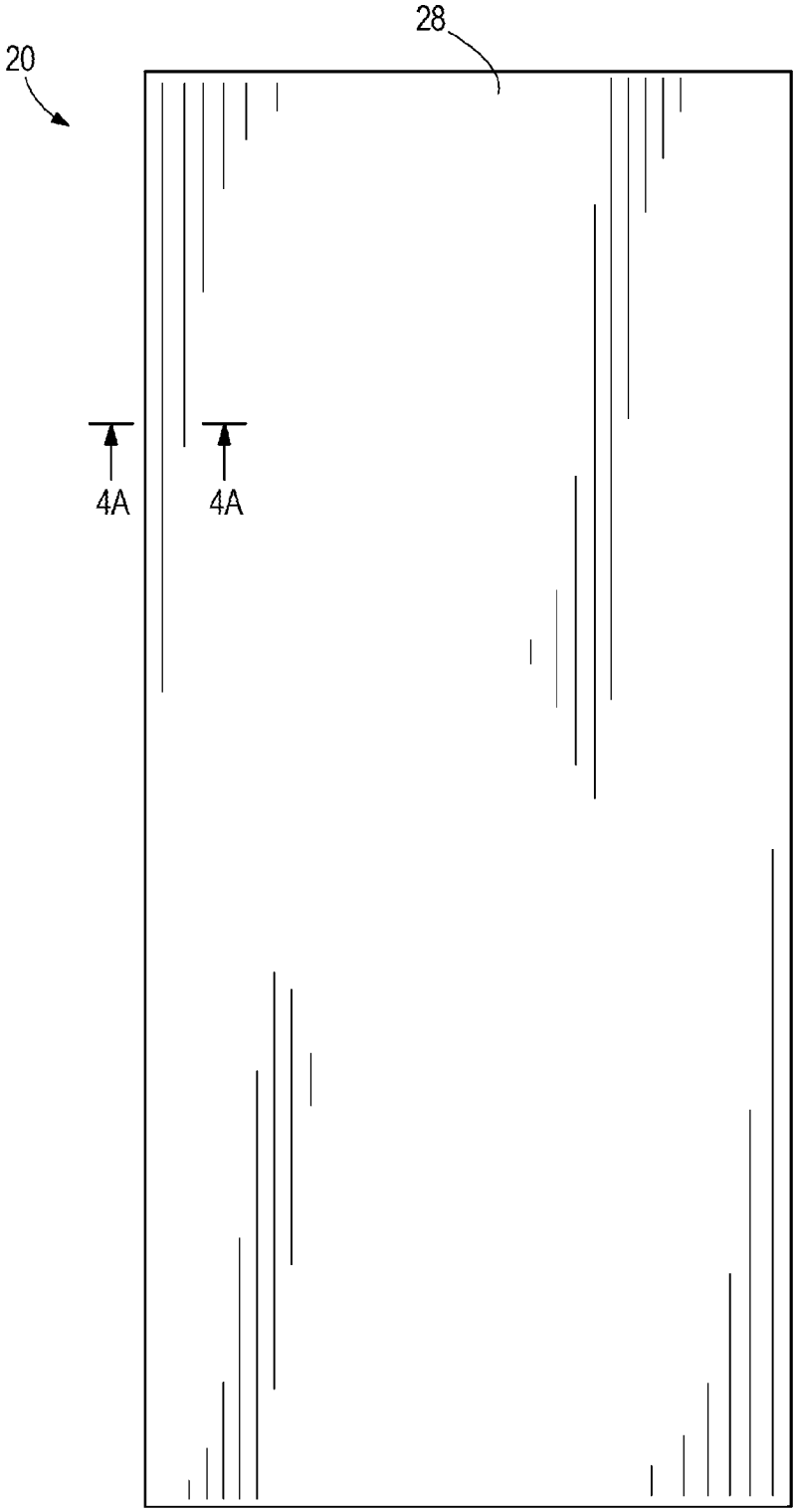
FIG. 4 is a plan view of spacers and skins coupled to each side of the bonded core assembly to create a rough form of the acoustical door.
Figure 4A:
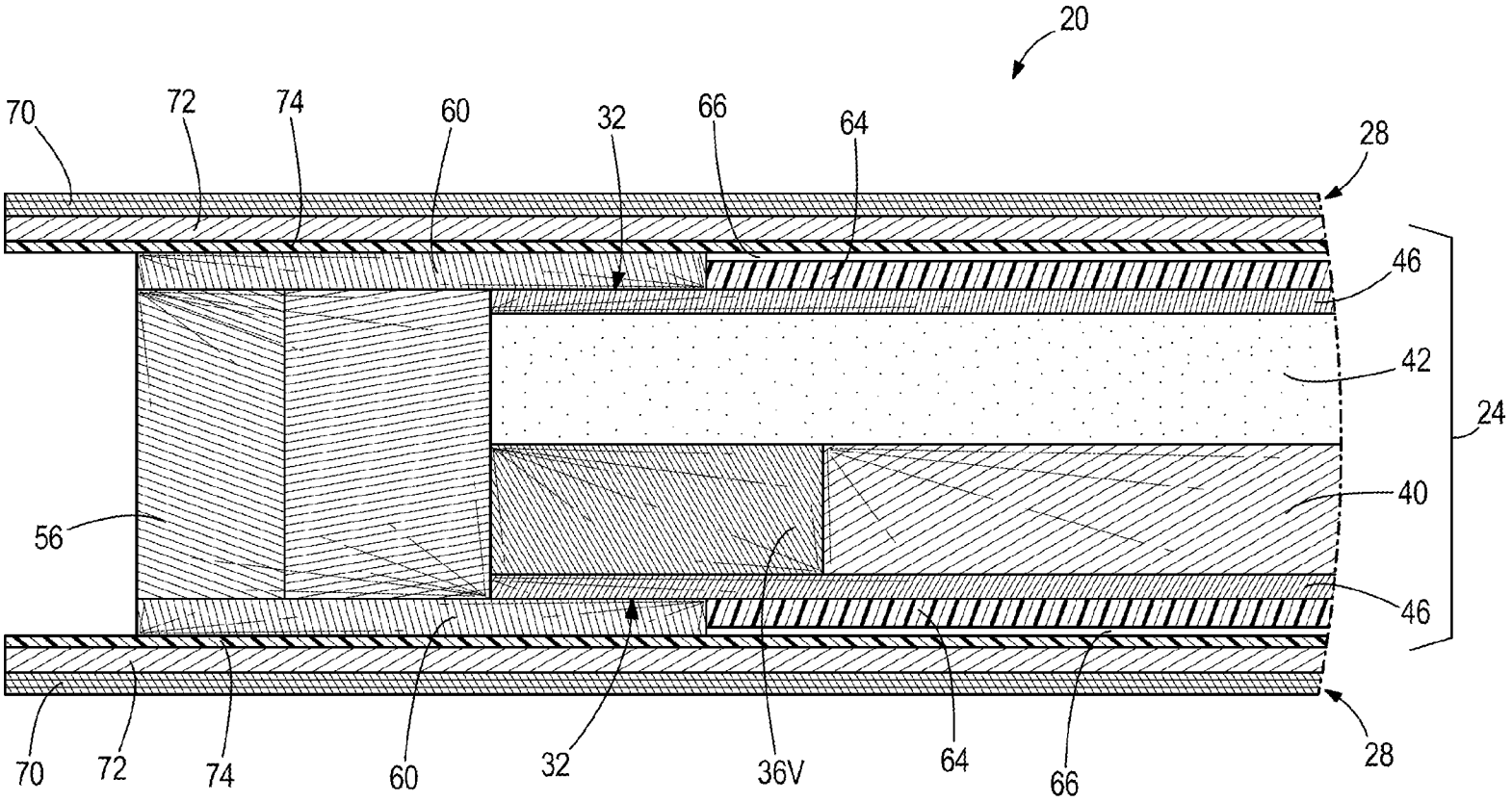
FIG. 4A is an enlarged, cross-section view of the rough form of the acoustical door of FIG. 4.
Figure 5A:
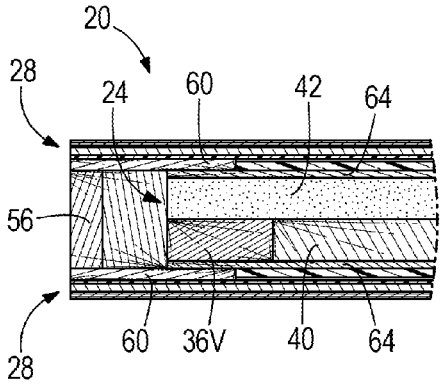
FIG. 5A is a cross-section view of the acoustical door of FIG. 5.
Figure 5:
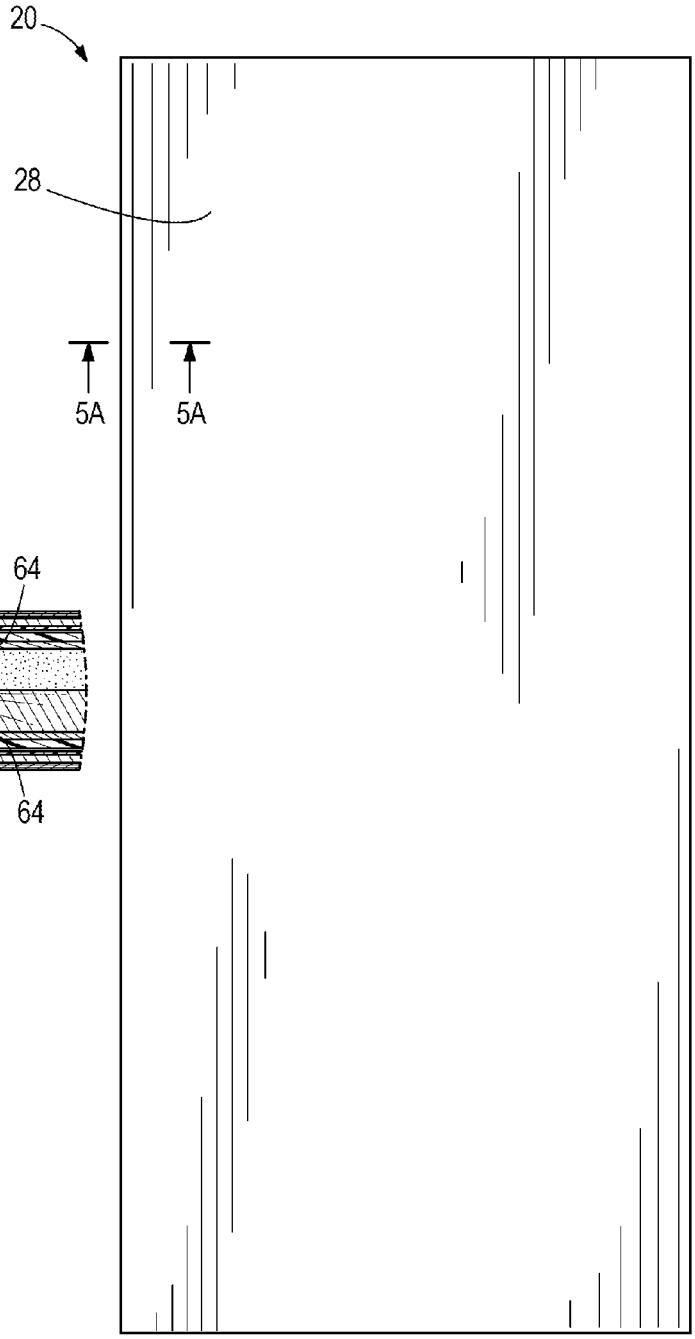
FIG. 5 is a plan view of the acoustical door, trimmed to final size.

An acoustical door 20 is illustrated in FIG. 5. The parts of the door 20 are described primarily with reference to the enlarged cross-section view of FIG. 4A, which shows the door 20 in a near-complete state just prior to final trimming. Following the general description of the door 20, the method of manufacturing the door 20 is described with reference to FIGS. 1-5 as a sequence of processes. The terms "horizontal" and "vertical" are used throughout the description for convenience, and are used in reference to a conventional mounting orientation for the door 20 as illustrated in FIG. 1 with "horizontal" being the left to right direction (the shorter dimension of the door 20), and "vertical" being the up and down direction (the longer dimension of the door 20). However, the use of "horizontal" or "vertical" is not meant to be limiting in any way, as doors according to aspects of the invention can be mounted in any number of orientations.

The acoustical door 20 includes a core 24 and a pair of skins 28 coupled to the core 24. The core 24 defines a top edge 26, a bottom edge 27, two side edges 30, and two opposing surfaces 32 corresponding to first and second opposing sides of the door 20, which opposing sides correspond to two spaces separated by the door 20 when installed. The core 24 includes two overlapping core layers 40, 42 of dissimilar material and a spacer frame, or array, including a plurality of overlapping spacer strips 36V, 36H. The spacer strips include a first set of spacer strips 36V extending along a first direction (e.g., vertical spacer strips). The spacer strips further include a second set of spacer strips 36H extending along a second direction (e.g., horizontal spacer strips) and overlapping the first set of spacer strips 36V. The first direction of the first set of spacer strips 36V is perpendicular to the second direction of the second set of spacer strips 36H. The spacer strips 36V, 36H can be high-density fiberboard spacer strips. The overlapping core layers can include a first layer 40 of a first material and a second layer 42 of a second material positioned within the spacer frame. The first layer 40 can be a low density fiberboard material (e.g., Celotex SOUNDSTOP®, available from Blue Ridge Fiberboard, Danville, Va.), and the second layer 42 can be mineral wool (e.g., 8-pound density mineral wool). Although other materials may be used for the first and second layers 40, 42, the materials are substantially dissimilar in at least one of: density, fiber type, and compression strength. The first and second layers 40, 42 can be of the same thickness, for example, about ½ inch, with thickness measured perpendicular to opposing surfaces 32 in FIG. 1A. Other thicknesses and other ratios of thicknesses between the first and second layers 40, 42 other than 1:1 are optional. In some constructions, the first and second layers 40, 42 are not bonded directly to each other. Rather, the spacer strips 36V, 36H are coated with adhesive to bond to each other at the locations of overlap and secure the core 24 together. By bonding the various core elements with only the spacer strips 36V, 36H, adhesive costs are reduced. Furthermore, the points of contact responsible for sound transmission are minimized and air spaces are created that provide acoustic breaks.

Figure 1B:
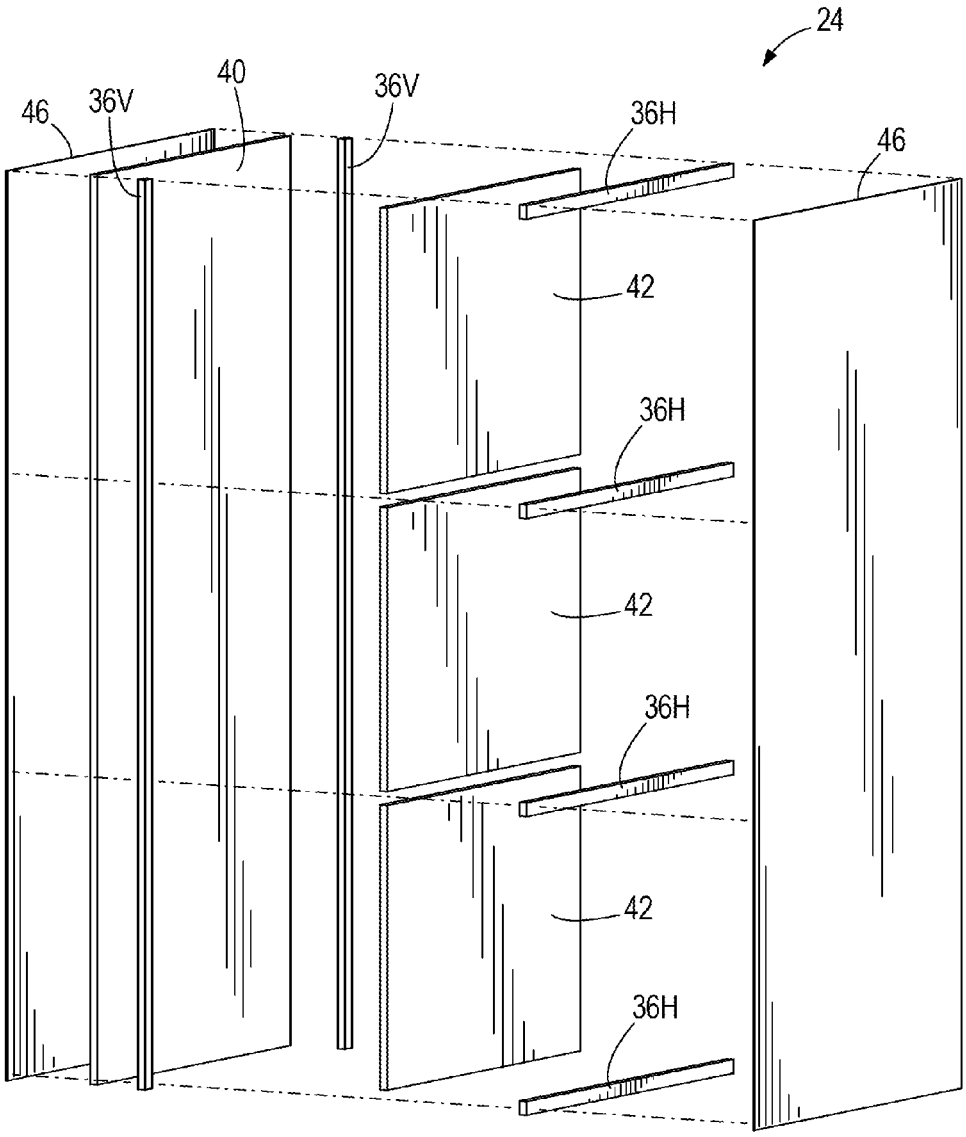
FIG. 1B is an exploded view of the core construction of FIG. 1.

The illustrated core 24 includes a spacer frame with two vertical spacer strips 36V and four horizontal spacer strips 36H (FIG. 1B). The vertical spacer strips 36V are positioned at the sides of the first core layer 40 and have a substantially equivalent thickness, while the horizontal spacer strips 36H are positioned at the top and bottom of each one of a plurality of panels (e.g., three panels) making up the second core layer 42. The panels of the second core layer 42 can have equal heights of about 24 inches in some constructions. All of the spacer strips 36V, 36H have a width (in plan view) of about 1.25 inches in the illustrated construction. The core 24 is finished by sandwiching the first and second layers 40, 42 with two crossband layers 46, which can be high density fiberboard, or similar material (e.g., 1/11 inch thick). The crossband layers 46 can be adhesively bonded to the respective spacer strips 36V, 36H. The core layers 40, 42, the spacer strips 36V, 36H, sandwiched by the crossband layers 46, form an inner core assembly or "bonded core assembly". The core 24 is very stiff with low density to provide excellent high frequency transmission loss.

Figure 2:
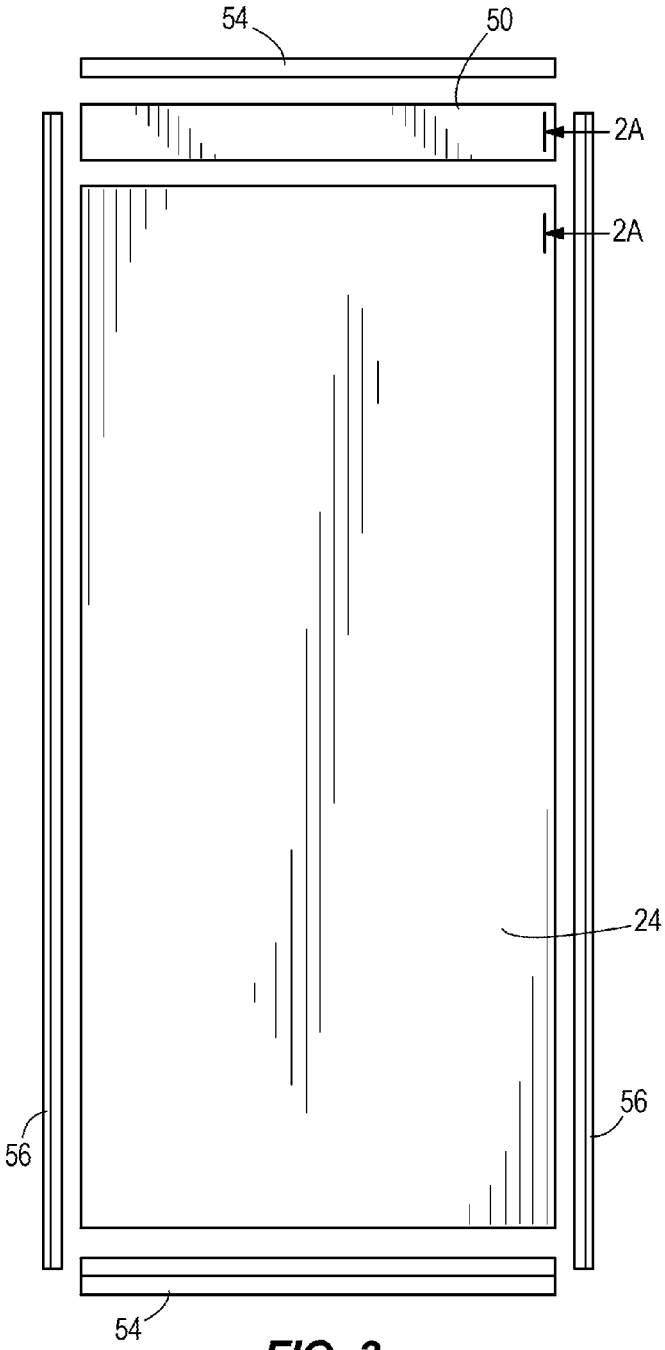
FIG. 2 is an exploded assembly view of the core construction (trimmed) of FIG. 1 in addition to blocking, stiles, and rails which make up a bonded core assembly.
Figure 2A:
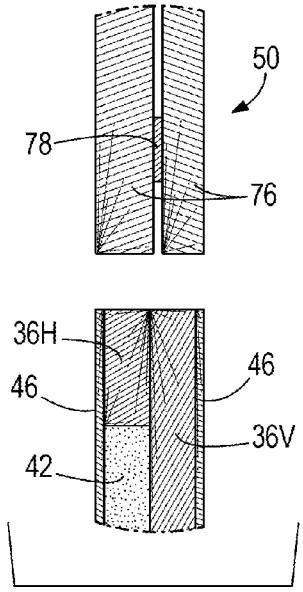
FIG. 2A is a cross-section view of the bonded core assembly of FIG. 2.

The core 24 extends throughout a majority portion of the door 20, but a minor portion (e.g., near a top end) may be provided with blocking 50 in place of the core 24 to provide a more solid substrate for screw-holding, in order to mount door-closing hardware, for example. The blocking 50 is positioned adjacent the core 24, between the two opposing skins 28. The blocking 50 is shown in FIG. 2 as extending a full width, equivalent to the core 24, but having a vertical span limited to less than 10 percent of the overall height of the door 20. In some embodiments, the blocking 50 can include two layers 76 with an air space therebetween (e.g., an air space having a thickness of more than 1/32 inch). The two layers 76 can have dissimilar thicknesses. Each layer 76 can be constructed of high-density fiberboard, and the layers 76 can be bonded together with an adhesive having a thickness corresponding to the air space. In some constructions, the adhesive includes strips of double-sided tape 78 in an arrangement that provides the air space between the layers 76. The double-sided tape 78 can include a non-rigid, vibration dampening material (e.g., foam, neoprene, etc.). One exemplary type of double-sided tape is 3M™ Double Coated Urethane Foam Tape (e.g., model 4008 having 1/8 inch thickness), which is an open cell polyurethane foam with acrylic pressure sensitive adhesive coating on both sides. Alternate core assemblies may include blocking of an alternate configuration, or no blocking at all.

Figure 3A:
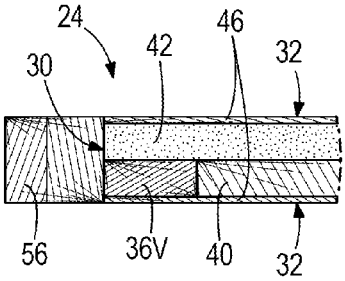
FIG. 3A is a cross-section view of the bonded core assembly of FIG. 3.
Figure 3:
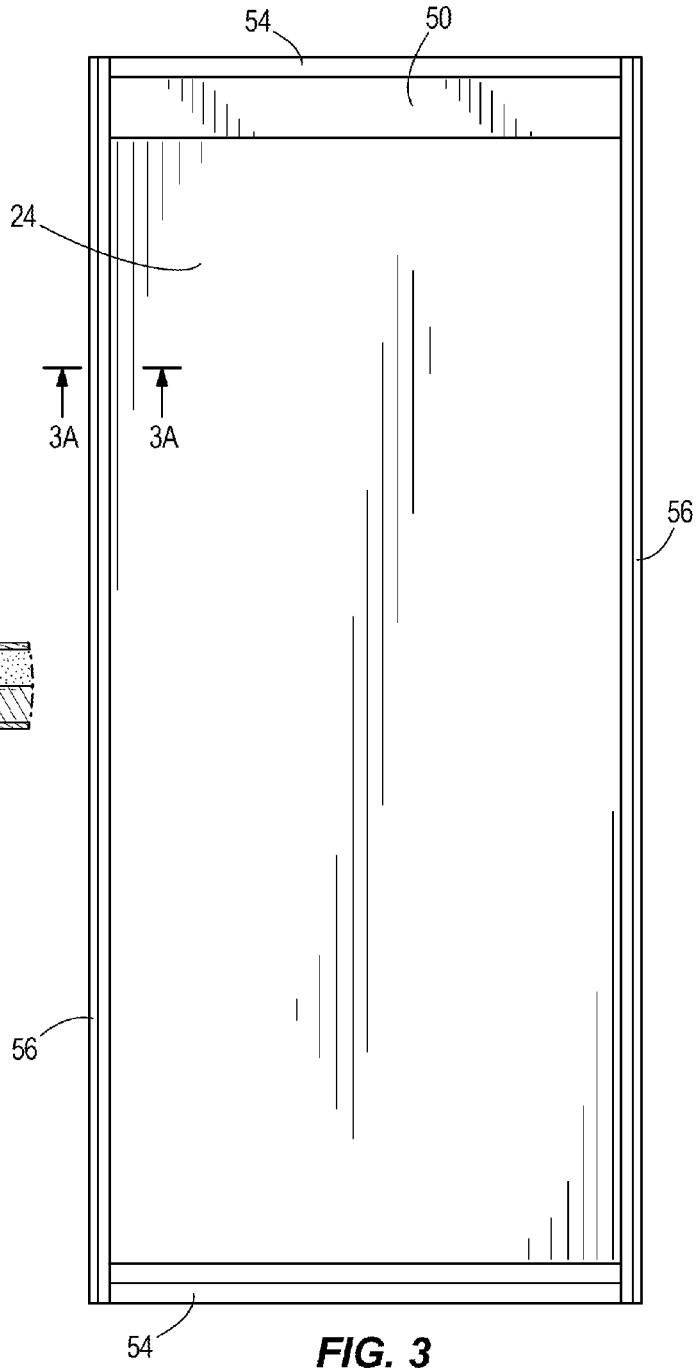
FIG. 3 is a plan view of the core construction assembled with the blocking, stiles, and rails, at which point in the manufacturing process, the bonded core assembly is sanded.

The core 24 is surrounded on its periphery (i.e., top, bottom, and side edges 26, 27, 30) by a pair of generally horizontal rails 54 and a pair of generally vertical stiles 56 (FIG. 3). If blocking 50 is included, the core assembly of the core 24 and the blocking 50 are surrounded on its periphery by the rails 54 and the stiles 56. The thickness of the rails 54 and the stiles 56 are substantially equivalent to the total thickness of the core assembly, including the crossband layers 46 and blocking 50.

A multi-layer skin 28, shown in FIG. 4, covers each face 32 of the core assembly and is coupled to the core assembly in spaced relationship with the respective core face 32 by one or more spacers 60. The spacers 60 can be provided about a periphery of the core assembly, and can extend over respective joints where the blocking 50 or one of the core edges 26, 27, or 30 and the adjacent rail 54 or stile 56 meet. The spacers 60 can have a thickness of about 1/8 inch (0.125 inch) and a width of about 2.5 inches. The spacers 60 can be constructed of high density fiberboard or similar material. Directly within the periphery defined by the spacers 60 is a layer 64 having a thickness less than the thickness of the spacers 60. For example, the layer 64 can have a thickness of about one hundred thousandths (0.100) inch. The layer 64 is constructed of a dense, limp material, such as vinyl. The vinyl layer 64 is not bonded to the underlying face 32 of the core assembly but simply held in place by the spacers 60. Because the spacers 60 and the vinyl layer 64 are both laid against the face 32 of the core assembly, and the vinyl layer 64 is slightly thinner, an air space 66 is created between an exterior-facing side of the vinyl layer 64 and an interior-facing side of the skin 28. This skin attachment construction, including the air space 66, is presented on both sides of the door 20.

The skins 28 are provided with high mass and low rigidity to enhance low frequency transmission loss. The mass of the skins 28 is also moved as far toward the exterior faces of the door 20 as possible. Each skin 28 is constructed from an aesthetic outer layer 70, a lead sheet 72, and a crossband layer 74. The aesthetic outer layer 70 can provide the exterior face of the door with an appealing wood grain, for example. The aesthetic outer layer 70 can be a 3-ply assembly (e.g., lumber veneer, crossband, lumber veneer). The lead sheet 72 provides a high density and overall mass just inside the aesthetic outer layer 70. The lead sheet 72 can have a thickness of about 1/16 inch (0.063 inch) or 1/32 inch (0.0315 inch) in some constructions. The crossband layer 74 can be an engineered synthetic wood-fiber veneer (e.g., Syn-Ply®, available from 3A Composites USA, Inc., Statesville, N.C.). The crossband layer 74 can have a thickness of about 0.026 inch in some constructions. The spacers 60 are adhesively bonded on one side to the skins 28 and on the other side to the surface 32 of the core assembly, rails 54, stiles 56, and/or blocking 50. Adhesive does not fully bond the skins 28 to the underlying vinyl layers 64. Although some adhesive may be provided between the skins 28 and the underlying vinyl layers 64, most of the surface area is left un-bonded and spaced apart so that the skin 28 can flex without undue restraint by the core. Thus, except for their periphery, the skins 28 are not fixedly coupled relative to the core assembly.

To manufacture the acoustical door 20 of the illustrated construction, the core 24 is assembled by laying the second layer 42 (e.g., the multiple panels of mineral wool) and the horizontal spacers 36H upon the first layer 40 and the vertical spacers 36V and bonding the spacers 36V, 36H together (FIG. 1). The outer crossband layers 46 are bonded by adhesive applied to the spacers 36V, 36H. The core 24 may be trimmed as shown in FIG. 2 and assembled (e.g., bonded with adhesive) with the blocking 50, the rails 54, and the stiles 56 to form the banded core assembly. Once assembled, the banded core assembly is sanded (FIG. 3) and the skins 28 are attached (FIG. 4). The skins 28, which include multiple layers as described above, can be prefabricated. In some constructions, the vinyl layers 64, the spacers 60, and the skins 28 are placed on the respective sides of the banded, sanded core assembly and cold pressed with adhesive to bond the skins 28 to the core assembly through the spacers 60. The vinyl layers 64 can be loosely applied to the core assembly, without any bond thereto, and simply bounded on all four edges by the spacers 60. Adhesive may be applied to localized areas of the exterior side of each vinyl layer 64 (e.g., by applying a squiggled bead) for bonding to the interior face of the corresponding skin 28, but a majority of the overlapping surface area of the vinyl layer 64 and the skin 28 is left un-bonded, leaving the gap or air space 66 due to the thickness difference between the vinyl layer 64 and the spacers 60. In some constructions, 75 percent or more of the overlapping surface area of the vinyl layer 64 and the skin 28 is left un-bonded. The skins 28 may be oversized for the core assembly and trimmed after assembly (FIG. 5). Portions of the rails 54, the stiles 56, and the spacers 60 may also be trimmed to achieve a predetermined door profile.

Various features and advantages of the invention are set forth in the following claims.

What is claimed is:

1. An acoustical door comprising:

an inner core assembly including a spacer frame having a first set of spacer strips extending along a first direction and a second set of spacer strips extending along a second direction, a first core layer positioned within the spacer frame, and a second core layer positioned within the spacer frame, the second core layer constructed of a material dissimilar from the first core layer;

a multi-layer skin spaced apart from the inner core assembly, the multi-layer skin including a sheet constructed of lead; and a spacer coupling the multi-layer skin and the inner core assembly around a mutual periphery, an air space being defined within the mutual periphery and between the multi-layer skin and the inner core assembly such that the multi-layer skin is configured to flex independent of the inner core assembly.

2. The acoustical door of claim 1, wherein the inner core assembly further includes a crossband layer adhesively bonded to the spacer frame.

3. The acoustical door of claim 1, wherein the first core layer overlaps the second core layer, the first core layer and the second core layer are not bonded.

4. The acoustical door of claim 1, wherein the first core layer has a first thickness, the second core layer has a second thickness, and the first thickness is substantially the same as the second thickness.

5. The acoustical door of claim 1, wherein the first core layer is constructed of low density fiberboard material.

6. The acoustical door of claim 1, wherein the second core layer is constructed of mineral wool.

7. The acoustical door of claim 1, wherein the second core layer is provided by a plurality of separate panels positioned within the spacer frame.

8. The acoustical door of claim 1, further comprising a blocking section positioned adjacent the inner core assembly between the multi-layer skin and an additional multi-layer skin provided on an opposing side of the inner core assembly, the blocking section including two layers of dissimilar thickness.

9. The acoustical door of claim 8, wherein the blocking section further includes double-sided tape positioned between the two layers of the blocking section to bond the two layers and define an air space there between.

10. The acoustical door of claim 8, wherein the two dissimilar layers of the blocking section are constructed of high-density fiberboard.

11. The acoustical door of claim 1, further comprising a frame including generally horizontal rails and generally vertical stiles, the frame surrounding a perimeter of the inner core assembly.

12. The acoustical door of claim 1, wherein the multi-layer skin includes an inner layer and an outer aesthetic layer, the lead sheet positioned between the inner layer and outer aesthetic layer.

13. The acoustical door of claim 1, wherein the spacer is constructed of high density fiberboard.

14. The acoustical door of claim 1, further comprising a vinyl layer positioned adjacent the air space and within the mutual periphery, the spacer has a first thickness, the vinyl layer has a second thickness and the first thickness is greater than the second thickness.

15. The acoustical door of claim 14, wherein the vinyl layer is unbound from the inner core assembly, and a majority of the surface area of the vinyl layer is unbound from the multi-layer skin.

16. The acoustical door of claim 1, further comprising a second multi-layer skin including a lead sheet, the second multi-layer skin spaced apart from the inner core assembly with a second spacer coupling the second multi-layer skin to the inner core assembly around a second mutual periphery, a second air space being defined within the second mutual periphery and between the second multi-layer skin and the inner core assembly such that the second multi-layer skin is configured to flex independent of the inner core assembly.

17. The acoustical door of claim 1, wherein the first direction of the first set of spacer strips is perpendicular to the second direction of the second set of spacer strips.

18. An acoustical door comprising:

an inner core assembly including a spacer frame having a first set of spacer strips extending along a first direction and a second set of spacer strips extending along a second direction, the first set of spacer strips are bonded to the second set of spacer strips at locations of overlap, a first core layer positioned within the first set of spacer strips, and a second core layer provided by a plurality of separate panels positioned within the second set of spacer strips, the second core layer constructed of a material dissimilar from the first core layer; and a skin coupled to the inner core assembly.

19. The acoustical door of claim 18, further comprising a spacer coupling the skin to the inner core assembly around a mutual periphery, an air space being defined within the mutual periphery and between the skin and the inner core assembly such that the skin is configured to flex independent of the inner core assembly.

20. The acoustical door of claim 18, wherein the skin is a multi-layer skin including a lead sheet, an inner layer, and an outer aesthetic layer, the lead sheet positioned between the inner layer and outer aesthetic layer.

21. The acoustical door of claim 18, wherein the inner core assembly further includes first and second crossband layers, respectively bonded to opposing sides of the spacer frame.

22. The acoustical door of claim 18, wherein the first core layer overlaps the second core layer, and the first core layer and the second core layer are not bonded together.

23. The acoustical door of claim 18, wherein the first core layer has a first thickness, the second core layer has a second thickness, and the first thickness is substantially the same as the second thickness.

24. The acoustical door of claim 18, wherein the first core layer is constructed of low density fiberboard material.

25. The acoustical door of claim 18, wherein the second core layer is constructed of mineral wool.

26. The acoustical door of claim 18, further comprising a blocking section positioned adjacent the inner core assembly between the skin and an additional skin provided on an opposing side of the inner core assembly, the blocking section including two layers of dissimilar thickness.

27. The acoustical door of claim 18, further comprising a frame including generally horizontal rails and generally vertical stiles, the frame surrounding a perimeter of the inner core assembly.

28. The acoustical door of claim 19, further comprising a vinyl layer positioned adjacent the air space and within the mutual periphery, the spacer has a first thickness, the vinyl layer has a second thickness and the first thickness is greater than the second thickness.

29. The acoustical door of claim 19, further comprising a second skin, the second skin coupled to the inner core assembly with a second spacer around a second mutual periphery, a second air space being defined within the second mutual periphery and between the second skin and the inner core assembly such that the second skin is configured to flex independent of the inner core assembly.

30. The acoustical door of claim 18, wherein the first direction of the first set of spacer strips is perpendicular to the second direction of the second set of spacer strips.

* * * * *